US006095380A

United States Patent [19]

Fagg et al.

[11] Patent Number: 6,095,380

[45] Date of Patent: Aug. 1, 2000

[54] DOSING DEVICE FOR A HIGHLY VISCOUS LIQUID

[75] Inventors: Andrew John Fagg, Cincinnati, Ohio; Roger Theophiel Germain Campens, Brabant, Belgium

[73] Assignee: The Procter & Gamble Company, Cincinnati, Ohio

[21] Appl. No.: 09/179,699

[22] Filed: Oct. 27, 1998

[51] Int. Cl.[7] ..... D06F 39/02

[52] U.S. Cl. ..... 222/463; 222/105; 206/0.5; 68/17 R; 68/235 R; 8/159

[58] Field of Search ..... 222/105, 187, 222/463; 68/17 R, 17 A, 207, 235 R; 8/158, 159; 206/0.5; 248/94, 99, 101

[56] References Cited

U.S. PATENT DOCUMENTS

| | | | |
|---|---|---|---|
| 846,587 | 3/1907 | Maechler | 248/94 |
| 934,937 | 9/1909 | Schaubel | 248/94 |
| 1,747,324 | 2/1930 | Savitt | 8/159 |
| 2,133,584 | 10/1938 | Spanel | 68/235 R |
| 4,026,131 | 5/1977 | Dugger et al. | 68/17 A |
| 4,075,105 | 2/1978 | Steiner et al. | 248/94 |
| 4,969,927 | 11/1990 | Schumann et al. | 8/159 |
| 5,083,327 | 1/1992 | Gillebaard | 4/506 |
| 5,148,951 | 9/1992 | Moure et al. | 222/386 |
| 5,161,264 | 11/1992 | Dugas | 4/506 |
| 5,388,298 | 2/1995 | Rutter et al. | 8/158 |
| 5,532,168 | 7/1996 | Marantz | 248/94 |
| 5,592,702 | 1/1997 | Gillebaard, Jr. | 4/506 |
| 5,720,056 | 2/1998 | Aymes | 4/488 |

FOREIGN PATENT DOCUMENTS

| | | |
|---|---|---|
| 0 362 664 | 4/1990 | European Pat. Off. . |
| 0 490 577 A1 | 6/1992 | European Pat. Off. . |
| 0 576 234 A1 | 12/1993 | European Pat. Off. . |
| 0 641 881 A1 | 3/1995 | European Pat. Off. . |
| WO94/004369 A1 | 4/1991 | WIPO . |

*Primary Examiner*—J. Casimer Jacyna
*Attorney, Agent, or Firm*—James C. Vago

[57] ABSTRACT

A dosing device for dispensing a highly viscous liquid includes a frame and a flexible sheet. The frame has an open top and an open bottom. The sheet is suspended from the open top of the frame for retaining the liquid within the sheet.

14 Claims, 2 Drawing Sheets

DOSING DEVICE FOR A HIGHLY VISCOUS LIQUID

FIELD OF THE INVENTION

This invention relates to the filed of dosing devices, and more particularly, to a dosing device for a highly viscous liquid which provides an accurate and complete transfer of the viscous liquid from the dosing device to the wash water within a washing machine.

BACKGROUND OF THE INVENTION

Traditionally, European consumers are familiar with in-wash dosing devices to administer both liquid and granular detergents when using an automatic washing machine. These in-wash dosing devices are typically filled with laundry detergent and placed directly in the drum during the washing process. This is due to the unique structure of European washing machines which fill the drum after the sump pump, below the drum, is filled. Thus, the dosing device is used to measure the detergent and also to prevent the detergent from filtering through the drum and into the sump pump prior to the drum filling.

In contrast, North American and Japanese consumers typically only use in-wash dosing devices but instead use a simple measuring device to properly measure the recommended amount of detergent for their washing cycle. This is because most North American and Japanese washing machines do not use a sump pump system but instead fill the washing drum immediately. As a result, the laundry detergent placed within the drum remains there regardless of when the detergent is added. For this reason, North American and Japanese consumers are unfamiliar with in-wash dosing devices which are placed within the washing drum.

The evolution of a highly viscous liquid laundry detergent product creates a need for a unique global dosing device. This highly viscous liquid laundry detergent has at least 40% suspended solids and sticks to all surfaces due to it containing both hydrophobic and hydrophilic species. As a result, this highly viscous detergent cannot be simply measured in a measuring device and poured into the washing drum as it will stick to the device. Therefore, like the European washing process, this highly viscous detergent must be measured in an in-wash dosing device and placed within the washing drum to ensure that the detergent is washed from the device during the washing process.

Unfortunately, washing machines used world-wide do not function in a similar manner. For example, U.S. and Japanese washing machines typically include a short cycle, cold wash, and low agitation. In contrast, European washers typically have a long cycle, warm wash, and high agitation. As a result, conventional in-wash dosing devices do not function properly to adequately dispense highly viscous liquid laundry detergent. These in-wash dosing devices are typically solid and float on top of the water in top loading washing machines. This can result in the liquid detergent remaining within the dosing device during the wash cycle which prevents the detergent from functioning properly. To solve this, the consumer could be required to add water to the in-wash dosing device to ensure that the device sinks, but this is not reliable nor feasible.

Therefore, what is needed is an in-wash dosing device for a highly viscous liquid laundry detergent which provides an accurate and complete transfer of the viscous detergent from the dosing device to the wash water within the washing machine.

SUMMARY OF THE INVENTION

According, it is an object of the present invention to provide an improved in-wash dosing device for a highly viscous liquid laundry detergent and/or fabric softener.

It is a further object of the present invention to provide a dosing device for dispensing a highly viscous liquid, comprising a frame having an open top and an open bottom, and a flexible sheet suspended from the open top of the frame for retaining the liquid within the sheet.

DETAILED DESCRIPTION OF THE DRAWINGS

Figure 1:
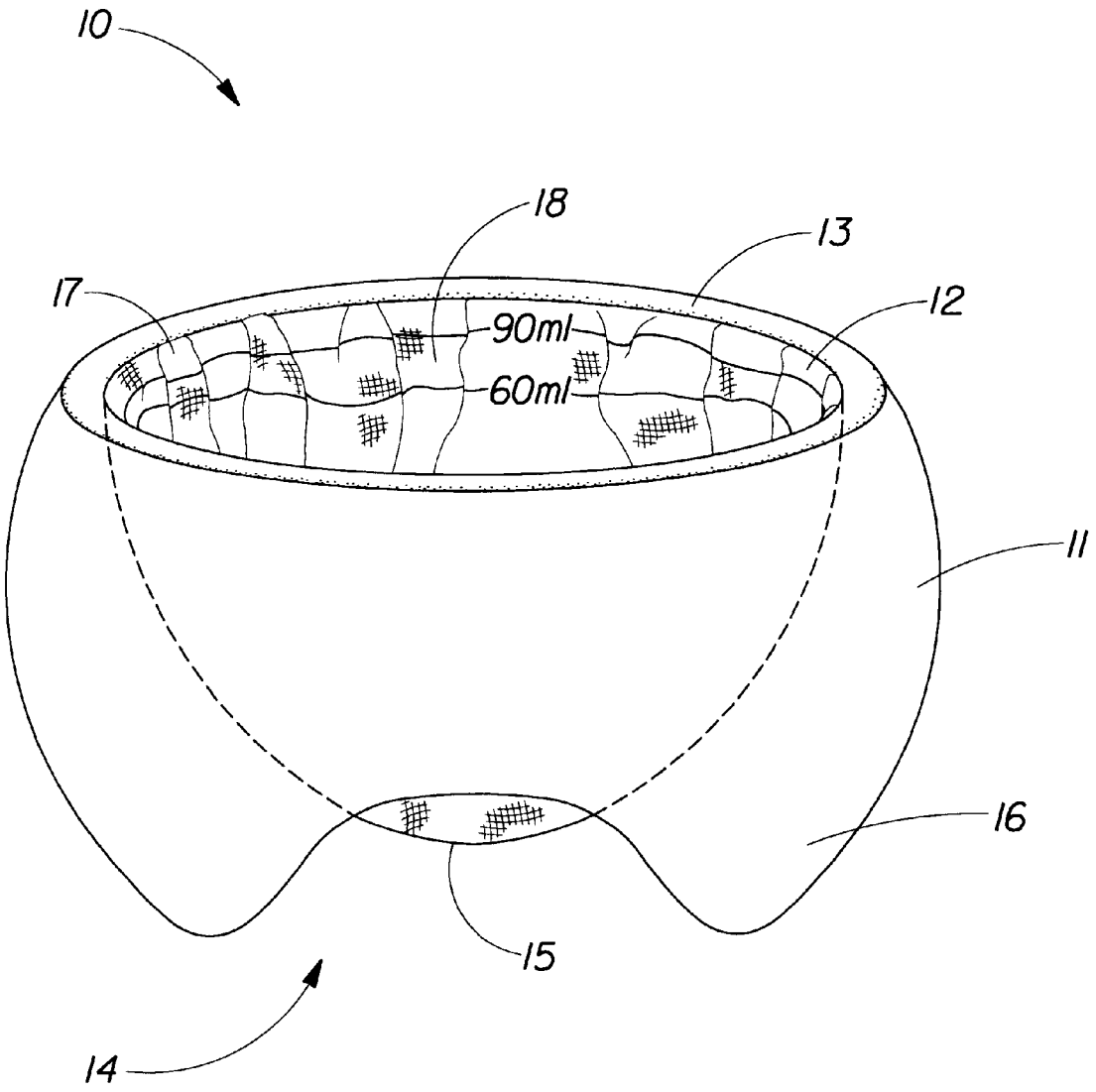
FIG. 1 is a perspective view of the preferred dosing device according to the preferred embodiment of the present invention.

Referring to FIG. 1, the preferred in-wash dosing device 10 has a frame 11 and a sheet or bag 12. The frame 11 preferably comprises an open top 13 and an open bottom 14. The sheet 12 is suspended from the top 13 of the frame 11, such that a bottom 15 of the sheet 12 is preferably suspended between the open top 13 and the open bottom 14.

The preferred frame 11 has four feet 16 for supporting the sheet 12 above a surface upon which the device 10 would be placed. In this way, any liquid placed within the device 10 through an opening 18 on the sheet 12 will not wick onto the surface below as the bottom 15 of the sheet 12 will be suspended above the surface.

The preferred sheet 12 is a flexible, polypropylene non-woven fabric but may comprise a variety of materials without deviating from the intent of the invention. The preferred sheet is also liquid-permeable but may be a solid sheet.

The present invention enables fast and complete transfer/release of a viscous product (having at least 40% suspended solids and a viscosity range between 1000–4000 centipoise/second at a shear rate of 20/second) in the washing machine in order to ensure proper product performance. This is particularly true for U.S. and Japanese washing machines which have a short cycle, low agitation, and use cold water. The flexible sheet 12 allows the product to efficiently dispense during the wash cycle. This is achieved by rubbing of the clothes on the inner part of the flexible sheet containing the viscous product, as well as by inversion of the flexible sheet by the clothes, followed again by rubbing of clothes.

The frame 11 is preferably elliptical shaped which provides a comfortable grip, while the feet 16 provide a stable profile to put the dispensing device 10 on top of the laundry without tipping over and spilling the product. The non-woven sheet 12 is pre-shaped in the form of a coffee filter, with two seams (one bottom and one side seam) for providing accurate volumetric dosage. The latter is enhanced by having colored hot-stamped dosing lines 17 and numerical volume indications. When the dosing device 10 is filled with the viscous product, seepage and wicking through the suspended bag is possible when the bag is in contact with a support or surface (due to capillary action). In order to avoid potential messiness due to product seepage, the device 10 is designed so that the suspended sheet 12 does not contact the surface (e.g., a table) if the device 10 is sat down.

Figure 2:
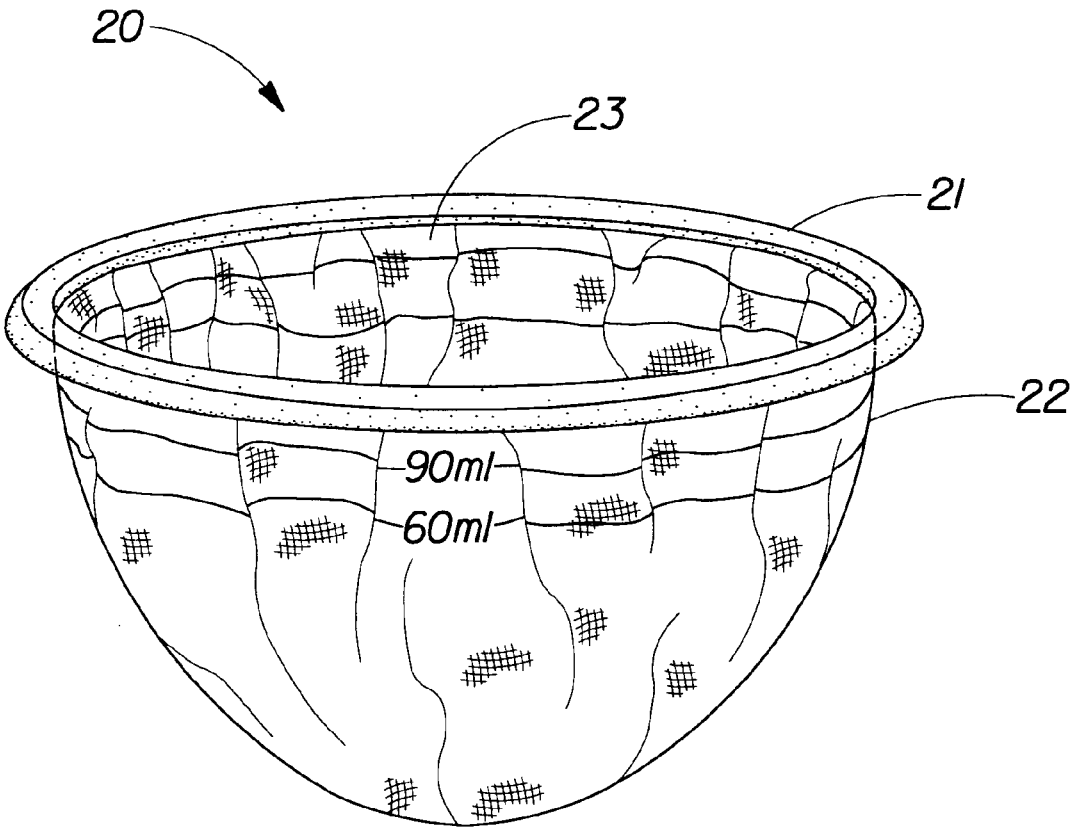
FIG. 2 is a perspective view of an alternate dosing device according to an alternate embodiment of the present invention.

Referring to FIG. 2, an alternate dosing device 20 has a substantially rigid ring 21 and a sheet 22 with the same characteristics as the preferred sheet 12. The sheet 22 is attached to the ring 21 such that an opening 23 is created for insertion of the highly viscous liquid. Since there is no frame to support the sheet 12, the flexible sheet can be supported in the ring 21 in a device holder (not shown).

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A dosing device for dispensing a highly viscous liquid in a washing machine, comprising:

a frame having an open top and an open bottom; and a flexible sheet suspended from said open top of said frame for retaining the liquid within said sheet, wherein said sheet has an opening unobstructed by said frame so that laundry can contact the inner part of the flexible sheet containing the liquid.

2. The dosing device of claim 1, wherein said frame has at least one foot for suspending said sheet between said open top and said open bottom.

3. The dosing device of claim 1, wherein at least one of said frame and said sheet has at least one dosing line.

4. The dosing device of claim 1, wherein said sheet is liquid-permeable.

5. The dosing device of claim 1, wherein said sheet is non-woven.

6. The dosing device of claim 1, wherein said sheet is invertible.

7. The dosing device of claim 1, wherein said sheet comprises polypropylene.

8. A dosing device for dispensing a liquid in a washing machine, comprising:

a ring having an opening;

a flexible sheet suspended from said ring; and a highly viscous liquid having at least 40% suspended solids retained within said sheet wherein said ring suspends said sheet to maintain an unobstructed opening in said sheet so that laundry can contact the inner part of the flexible sheet containing the liquid.

9. The dosing device of claim 8, wherein said sheet has at least one dosing line.

10. The dosing device of claim 8, wherein said liquid has a viscosity range between 1000–4000 centipoise/second at a shear rate of 20/second.

11. The dosing device of claim 8, wherein said sheet is liquid-permeable.

12. The dosing device of claim 8, wherein said sheet is non-woven.

13. The dosing device of claim 8, wherein said sheet is invertible.

14. The dosing device of claim 8, wherein said ring is substantially rigid.

* * * * *